United States Patent [19]

Baus

[11] Patent Number: 4,512,045

[45] Date of Patent: Apr. 23, 1985

[54] STRUCTURAL ASSEMBLY, FOR SHOWER PARTITION OR THE LIKE

[76] Inventor: Heinz G. Baus, Wartbodenstrasse 35, CH-3626 Hünibach/Thun, Switzerland

[21] Appl. No.: 526,825

[22] Filed: Aug. 26, 1983

[30] Foreign Application Priority Data

Aug. 28, 1982 [DE] Fed. Rep. of Germany ..... 3232084

[51] Int. Cl.[3] ..... A47K 3/22

[52] U.S. Cl. ..... 4/610; 4/607; 4/609

[58] Field of Search ..... 4/607, 610, 609, 612, 4/614, 605, 608; 16/90, 87 R, 91, 96 R, 93 R; 49/408, 411, 431, 428, 409

[56] References Cited

U.S. PATENT DOCUMENTS

| | | | |
|---|---|---|---|
| 3,111,208 | 11/1963 | Grossman | 4/607 X |
| 3,879,806 | 4/1975 | Armstrong | 4/610 |
| 4,090,265 | 5/1978 | Baus | 4/607 |
| 4,228,560 | 10/1980 | Baus | 4/607 X |
| 4,258,443 | 3/1981 | Baus | 4/607 X |
| 4,358,863 | 11/1982 | Jacoben | 4/607 |
| 4,445,239 | 5/1984 | Jacoben | 4/610 X |

FOREIGN PATENT DOCUMENTS 8013940 8/1981 Fed. Rep. of Germany .

*Primary Examiner*—Henry K. Artis

*Attorney, Agent, or Firm*—Schwartz, Jeffery, Schwaab, Mack, Blumenthal & Koch

[57] ABSTRACT

Structural assembly, more particularly for a shower partition, comprising a door support in the form of a profiled rail having, in an outer face thereof, a first channel, of which one side flange forms a groove, and a facing panel mounted in this first channel. The facing panel is held in the first channel by a connecting element fitting in the groove. Existing arrangements of this type are relatively wide, of correspondingly large structural volume, and of high material costs. In order to obtain a structurally simple and inexpensive connection between the facing panel and the profiled rail, it is proposed that the panel be provided with a longitudinal second channel which opens towards the groove of the first channel. The connecting element engages partly in the second channel and partly in the groove.

18 Claims, 6 Drawing Figures

STRUCTURAL ASSEMBLY, FOR SHOWER PARTITION OR THE LIKE

The invention relates to a structural assembly, particularly for use in a shower partition, comprising a support member in the form of a profiled rail having, on one outer surface, first channel of which one side flange is undercut to form a groove, and having a facing panel arranged in the first channel by means of a connecting element lodged partly in the undercut groove.

German Utility Model No. 80 13 940 describes an assembly of this kind for a shower partition. The outer face of the profiled rail, visible to a facing observer, comprises a channel into which is inserted a facing panel made of plastic, wood, or the like. The channel is provided with undercut grooves in which a resilient connecting element engages, the said element being in turn in communication with the facing panel. The connecting element, and the facing panel are of considerable height at right angles to the outer surface of the profiled rail, and this accordingly reduces the space available inside of the rail. For a profiled rail of predetermined structural height, the overal structural volume and structural height of the assembly must be correspondingly great. On the whole, this requires a not inconsiderable amount of material, as a result of which the material costs and total weight of the assembly are correspondingly great.

It is therefore an object of the present invention to to provide a structural assembly of the above type at low cost and in such a manner that the structural height required to fit the facing panel to the profiled rail is comparatively small. A reliable and properly operable attachment of the facing panel to the profiled rail is thus ensured, as well as inexpensive production, even in large numbers, especially the connecting element. Another object is to make it possible to fit the facing panel simply and reliably to the profiled rail. Another object is to detach the facing panel from the profiled rail, if necessary, without difficulty. Simple replacement of a facing panel is thus possible at any time.

In order to accomplish these objects, it is proposed that the facing panel comprise a longitudinal second channel which opens towards the groove in one of the flanges of the first channel and that the connecting element be arranged on the inner of the facing panel, partly in the longitudinal second panel and partly in the groove.

The assembly according to the invention is of simple and inexpensive construction. An extremely low overall height is obtained by providing the connecting element on the inward side of the facing panel. A reliable and strong mounting of the connecting element is made possible by the longitudinal second channel opening towards the first channel broove, thus preventing inadvertent release of the facing panel. The longitudinal second channel provided according to the invention also constitutes a mirror-image of the groove of first guide channel. The connecting element is located partly in the groove of the first channel and partly in the second channel, thus ensuring firm anchorage. Within the scope of the invention, it is also possible for the facing panel to be provided with two longitudinal second channels open on both sides. Arranged in these two second channels are corresponding connecting elements which engage in respective laterally arranged grooves of the side flanges of the first channel of the profiled rail. If only one longitudinal second channel is provided then, according to the invention, one stepped leg of the facing panel engages in the other, opposing groove of the first channel.

In one interesting embodiment, one web or leg of the facing panel rests upon the bottom of the first channel, in which case the second channel for the connecting element may be located in this said web or leg. On the one hand, the web or leg makes it possible to achieve considerable stiffness in the facing panel and, on the other hand, it ensures satisfactory support thereof on the profiled rail. If any force acts upon the surface of the facing panel, damage to or bowing thereof are practically eliminated, but in spite of this, the facing panel may be made relatively flat, require little material, and thus have little weight.

In another embodiment, the leg is straight and arranged substantially parallel with the inner face or upper surface of the facing panel and the longitudinal second groove is thus formed by the said leg and inner surface of the facing panel. On the one hand, the leg provides reliable support and accommodation of the connecting element in the facing panel and, on the other hand, this results in a particularly compact and space-saving construction. Assembly is not inconsiderably facilitated, since the connecting element is initially simply slid or inserted into the longitudinal second channel with no need for accurate alignment or locking.

In still another embodiment, the connecting element comprises a lateral projection which projects beyond one side edge of the facing profile and engages in the associated groove of the first channel. This is a particularly simple way of making it possible for the projection to travel comparatively long distances laterally, or in a plane parallel with the surface of the facing panel, as it is inserted into the profiled rail. Furthermore, during assembly, it is a simple matter to check whether the connecting element is correctly inserted into, or connected to, the facing panel.

In yet another embodiment, the width of the straight leg extending in the direction of the longitudinal axis of the profiled rail amounts to at least 25% of the overall width of the facing panel. This provides a favourable compromise between the amount of material used and a reliable connection. The connecting element can be reliably supported in the second channel thus designed which is located between the comparatively long leg and the inner surface of the facing panel. This is of interest in the event of forces acting from the outside which might tend to rip the facing panel out of the first channel. The design-width of the leg ensures reliable support of the connecting element and prevents inadvertent release of this element from the second channel.

According to these embodiments, the outer surface of the facing panel, the outer surface of the profiled rail, and/or parts thereof are all located at least approximately in the same plane. The facing panel is, as it were, embedded in the outer surface of the profiled rail, so that possible lateral forces cannot in practice act upon the said facing panel. It is obvious that this reliably prevents damage to, or release of, the facing panel, even under the heaviest stresses.

According to still another embodiment, the connecting element comprises at least one resilient part and/or area which acts substantially perpendicularly to the bottom surface of the first channel and/or the inner surface of the facing panel. This resilient part or area provides suitable bracing of the facing panel in the profiled rail, substantially perpendicularly to the upper or outer surface thereof. The facing panel is thus braced in the profiled rail both perpendicularly to the surface, by the said resilient part or area and laterally, by the locking means according to the invention. This ensures that the mounting of the facing panel in the profiled rail is reliable and meets all operational requirements.

In one desirable arrangement, the resilient part is in the form of a tongue obtained by producing, preferably stamping out, a preferably U-shaped slot extending over the entire height of the connecting element, and then bending the tongue out of the said connecting element. A tongue of this kind is simple to make without special expenditure, thus making it possible to keep production costs low.

According to one practical arrangement, the projection and/or a lever connected thereto is of a predetermined length in the direction of the longitudinal axis of the profiled rail. The projection and/or lever thus running in the direction of the longitudinal axis, make it a particularly simple matter to predetermine the length of spring travel and the obtainable spring force.

It is desirable to arrange, between the projection and the remainder of the connecting element, a preferably approximately L-shaped slot. The width of this slot is predetermined, so that when the facing panel, together with the connecting element, are inserted, the spring can yield resiliently and can be pressed, as it were, into the said slot. This is a reliable way of eliminating locking or clamping.

In order to achieve inexpensive production, the projection and the tongue are produced in a single operation, preferably by stamping out the above-mentioned slot. It is to be noted that the connecting element may easily be made from strip material, the projections and resilient parts or tongues being spaced suitably apart in the longitudinal direction.

Thus, when the connecting element is of the same length as the facing panel, several similarly designed projections and tongues are distributed over the length. If necessary, however, several small parts of appropriately designed connecting elements may also be provided for a single facing panel, each connecting element having at least one projection and one resilient part or corresponding tongue. In all cases, however, it is desirable to prefabricate the connecting element endlessly, as it were, in a long strip, cutting it to be desired length as required.

According to one practical feature, the connecting element may be designed as a moulded plastic part. Mouldings of this kind can be made in the desired shape and to the desired dimensions particularly simply, in large numbers and inexpensively.

According to one particularly interesting variant, the connecting element is resiliently deformable in the direction of the longitudinal axis. Thus when the facing panel and connecting element are inserted, a reduction ih overall width takes place at right angles to the longitudinal axis, in such a manner that the outer edge or the connecting element slides upon the associated inner edge which is located in the vicinity of the surface of the profiled rail. As a result of the elastic or flexible properties of the material of the connecting element according to the invention, an increase in overall width takes place after the insertion, in such a manner that a part of the said connecting element engages in the associated groove in the profiled rail, thus ensuring a firm and reliable connection.

According to one practical embodiment, the connecting element is approximately wave-shaped in the direction of the longitudinal axis so that, after insertion into the first channel, a lateral arc, or the like, engages in the associated groove in the profiled rail.

According to a further embodiment, the connecting element is of substantially constant crosssection in the direction of the longitudinal axis, the said cross-section being reducible for insertion into the groove of the profiled rail. As a result of the resilient properties of the material, a cross-sectional reduction takes place in such a manner that the connecting element previously inserted into the second channel has no difficulty in sliding upon the inner edge of the profiled rail. After insertion, the load on the connecting element is relieved, so that the cross-section is restored to its original size and the connecting element finds itself partly in the said groove in the profiled rail and partly in the second channel in the facing panel.

From the point of view of production costs, it has been found particularly expedient to provide a connecting element made of rubber or some resiliently deformable synthetic material. For example, the said connecting element may be made from connercially available rubber or plastic shapes of circular or possibly oval or other cross-section which may be cut to the desired length. In this case, the length of the connecting element is predetermined in such a manner that, after it has been placed in the second channel of the facing panel provided, the ends of the connecting element project, by a hand's breadth for example, beyond the facing panel. For insertion into the profiled rail, the connecting element must then be stretched longitudinally, either by hand or, if necessary, by a suitable automatically controlled machine, in order to achieve the reduction in cross-section required according to the invention. After the said connecting element has been inserted into the profiled rail, the projecting ends of the element are simply cut off. This obviously ensures a particularly simple connection between the facing panel and the profiled rail which can be carried out with a minimum of labour.

In one special embodiment, the facing panel has an approximately centrally located web, with a straight leg, which rests upon the bottom of the first channel and, in one outer side, a stepped leg engaging in an associated groove in the other flange of the profiled rail. In this embodiment, therefore, the stepped leg of the facing panel engages, on the one side, directly in the one groove whereas, on the other side, the connecting element, which is held by the approximate central straight leg, engages in the other groove in the profiled rail. This ensures a particularly reliable and firm connection which also permits particularly simple assembly.

Accordingly, the invention is broadly claimed herein as a structural assembly, for a shower partition or the like, of the type comprising: a support member formed with an elongated first channel having a bottom surface and opposed longitudinal side flanges, one of said side flanges defining a groove opening over said bottom surface; an elongated facing panel fitting into said first channel and having opposed side edges disposed between said channel side flanges, and a connecting element interconnecting said support member and said facing panel, said connecting element engaging into said groove, the improvement wherein:

said facing panel is formed with means defining a second channel opening toward said groove, in interconnected condition of said support member and said facing panel;

said connecting element, when in said interconnected condition, is mounted partly in said second channel of said facing panel and partly in said groove of said one of said first channel side flanges;

said connecting element is made of resilient material, and said other of said first channel side flanges and the adjacent edge of said facing panel are formed with interlocking means whereby said panel member with said connecting element inserted in said second channel form a sub-assembly which may be mounted and removed from said support member by pivotal movement of said assembly about said interlocking means to allow resilient engagement and removal of said connecting element in and out of said groove.

Further characteristics and advantages of the invention will be gathered from the following description of embodiments thereof, in conjunction with the drawing attached hereto, wherein.

Figure 1:
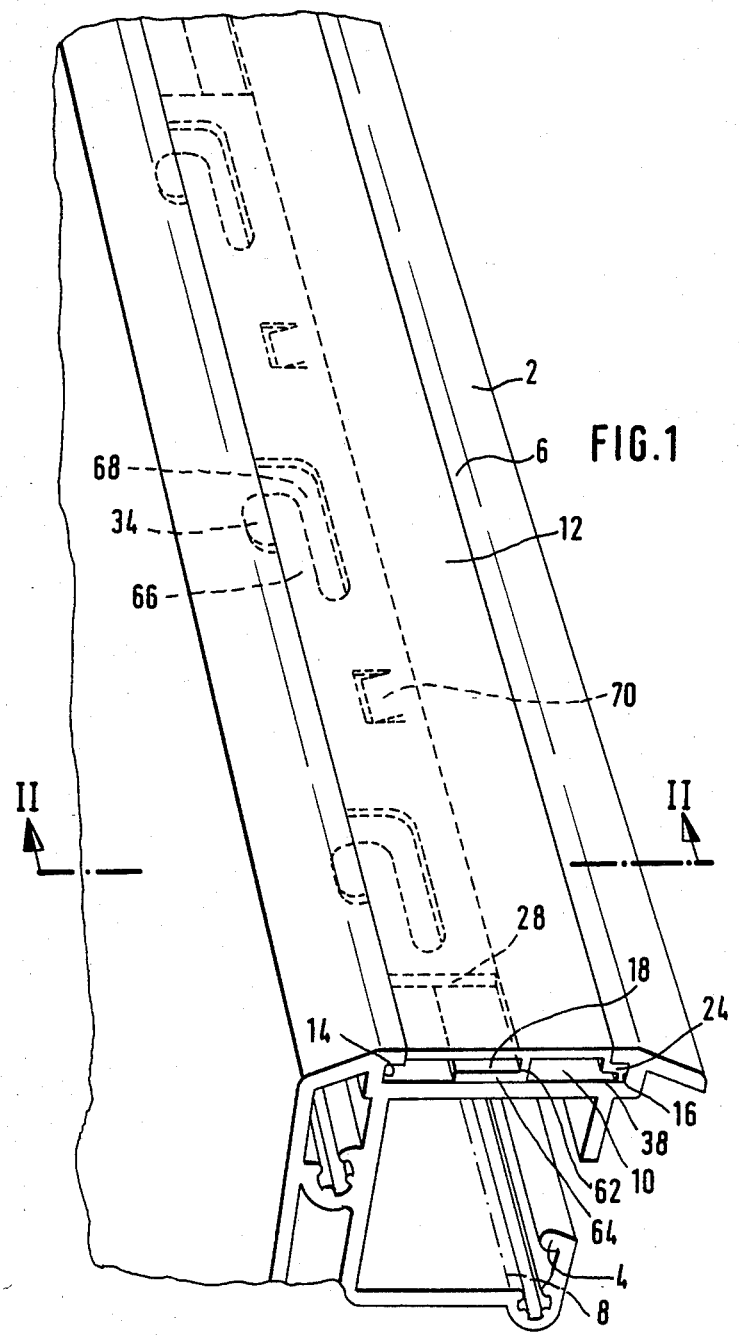
FIG. 1 is a diagrammatical perspective view of a structural assembly including a profiled rail and a facing panel.

FIG. 1 illustrates a structural assembly comprising a support member shaped as a profiled rail 2 forming the upper guide-rail of a shower partition. Located inside the profiled rail 2 is a guide-track 4 upon which rollers, or the like, (not shown), are mounted for the attachment of a sliding door, in known manner. Other, similarly designed guide-tracks may be used if necessary. On its outer face 6, visible to an observer for example, the profiled rail 2 is formed with a first channel 10 running in the direction of the longitudinal axis 8, into which channel 10 a facing panel 12 is inserted. The channel 10 is undercut in its side flanges to define grooves 14, 16 that are approximately rectangular in cross-section although they may have other cross-sectionl shapes, within the scope of the present invention.

One edge of the facing panel 12 defines a stepped leg 24 which engages into the groove 16 of the profiled rail 2. Located approximately centrally of the facing panel 12 is a web 62 extending toward the bottom surface 38 of the first channel 10. This web 62 carries a straight leg 64 which rests upon the bottom surface 38. This straight leg 64 runs in a direction contrary to that of the stepped leg 24, namely towards the groove 14. The web 62 and leg 64 provide a longitudinal second channel 18 which opens towards the groove 14. Inserted into the second channel 18 is a generally flat elongated connecting element 28 which engages into the groove 14 by means of a lateral projection 34 designed as a latch. A lever 66, connected to the latch 34 is obtained by cutting out or stamping out an L-shaped slot 68. The connecting element 28 is made of a resilient material, more particularly a synthetic material or metal so that, with the aid of lever 66, resilient engagement of the latch 34 in the groove 14 is made possible. The connecting element 28 further has a resilient presser part 70 which provides it with a bracing force acting in a direction perpendicular to outer surface 6 and to the bottom surface of the first channel 10. This dual spring action, in two directions at right angles to each other, prevents undesired back and forth sliding of the connecting element 28 and also of the facing panel 12. The fact that the resilient latch 34 easily ensures the required bracing of the connecting element 28, on the one hand in the groove 14 and, on the other hand, against the web 62, needs no special emphasis. In this embodiment, the connecting element 28 comprises three such latches 34 and two resilient parts 70, the said connecting element 28 being held at a certain distance from the surface of the profiled rail 2. It may be seen that such s connecting element has the same length as the profiled rail 2 itself. However, the connecting element 28 may also be substantially shorter that the profiled rail 2. In which a case a plurality of such short connecting elements may be provided along the full length of the profiled rail 2.

According to another embodiment, not shown, the central web 62 may have an additional leg extending in a direction opposite to that of the above-mentioned leg 64. The two legs, and the central web 62, thus are approximately T-shaped in cross-section and, in this case, two longitudinal second channels 18 are provided, the said channels being open towards the associated grooves 14, 16, of the profiled rail 2. The said additional leg, bearing upon the bottom surface of the profiled rail 2, can then engage directly into the associated groove or, here again, a connecting element may be provided, corresponding to the connecting element already described hercinbefore.

Figure 2:
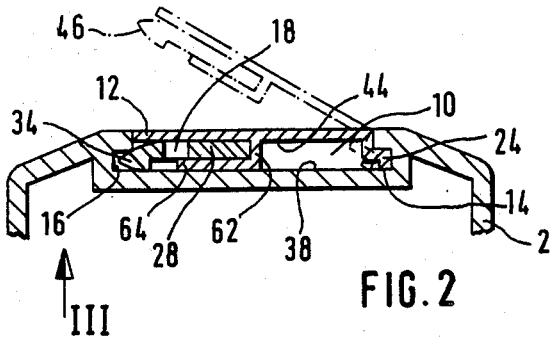
FIG. 2 is a partial cross-section through a somewhat modified profiled rail along the line II—II in FIG. 1.

FIG. 2 shows, in part, a cross-section through a somewhat modified profiled rail, taken along line II—II in FIG. 1. The first channel 10, the facing panel 12, and the connecting element 28 are all as described in connection with FIG. 1. A stepped leg 24 of the facing panel 12 engages into the groove 14 of the profiled rail 2 to form an interlocking means. It should be emphasized here that leg 24 also rests upon the bottom surface 38 of the first channel 10. The straight leg 64 on the central web 62 also rests against the bottom surface 38, thus ensuring an overall stable arrangement and mounting of the facing panel 12 in the profiled rail 2. The straight leg 64 runs substantially parallel with the inner surface 44 of the facing panel 12. Inserted into the longitudinal second channel 18, thus formed, is the connecting element 28, the latch 34 of which engaging in the groove 16 of the profiled rail 2. The facing panel 12, with the inserted connecting element 28, is shown in dotted lines during assembly. The stepped leg 24 of the facing panel 12 is first inserted in the groove 14. Final mounting is effected by simply pressing the facing panel 12 down towards the surface 38 of the first channel 10, the resiliently arranged latch being first forced back towards the web 62 and then engaging into the groove 16. In order to facilitate these operations, the nose 46 of the latch 34 is given a rounded contour, as shown.

Figure 3:
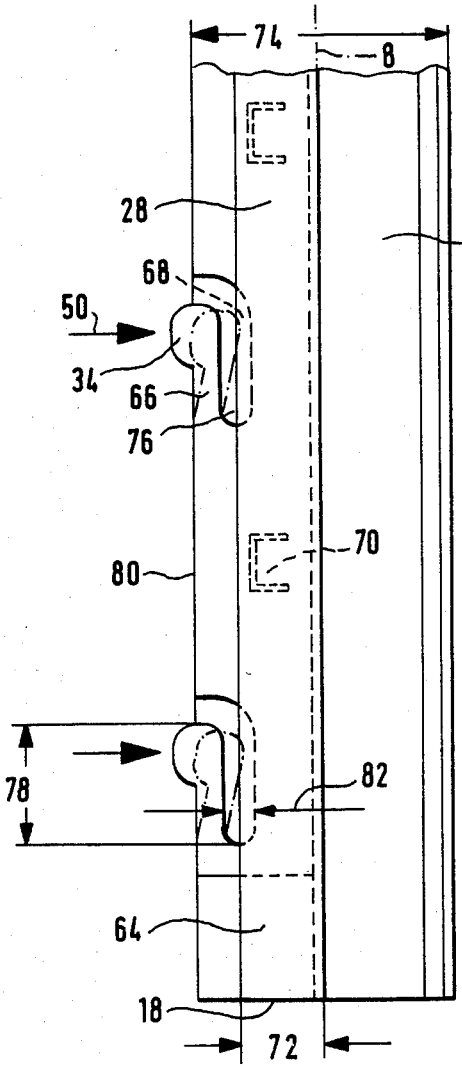
FIG. 3 is a plan view of the facing panel with inserted connecting element, as seen in the direction of arrow III in FIG. 2.

FIG. 3 is a plan view of the facing panel 12, with the connecting element 28 inserted, when looked at in the direction of arrow III in FIG. 2, that is towards inner surface 44, the rail 2 being removed. The straight leg 64, running in the direction of longitudinal axis 8, has a width 72 amounting to at least 25% of the overall width 74 of the facing panel 12, thus ensuring that the connecting element 28 is safely and reliably supported in the second channel 18 thus formed. It is also important that the top edge 76 of the straight leg 64 run approximately through the middle of the lever-making slot 68. This gives resilient mobility to the lever 66 and to the leg 64 in a direction at right angles to inner surface 44 or to the bottom surface 38. The L-shaped slot 68 makes it possible to bend latch 34 resiliently back, in the direction of arrow 50, FIG. 3, into the position shown in dotted lines. Lever 66 has a predetermined length 78 in the direction of the longitudinal axis 8. This length 78 may be adapted to the relevant requirements, taking into account more particularly the resiliency and strength of the material of which the connecting element 28 is made. In the embodiment illustrated, at least two latches 34 and resilient parts 70 are provided and additional latches and resilient parts, or possibly additional short connecting elements of corresponding design, may obviously be provided over the whole length of the profiled rail 2. A part of the latch 34, or the nose thereof, projects beyond the outer edge 80, width 82 of slot 68 being selected, according to the invention, in such a manner that the latch 34 be pressed unimpededly into the position shown in dotted lines when the facing panel is inserted.

Figure 4:
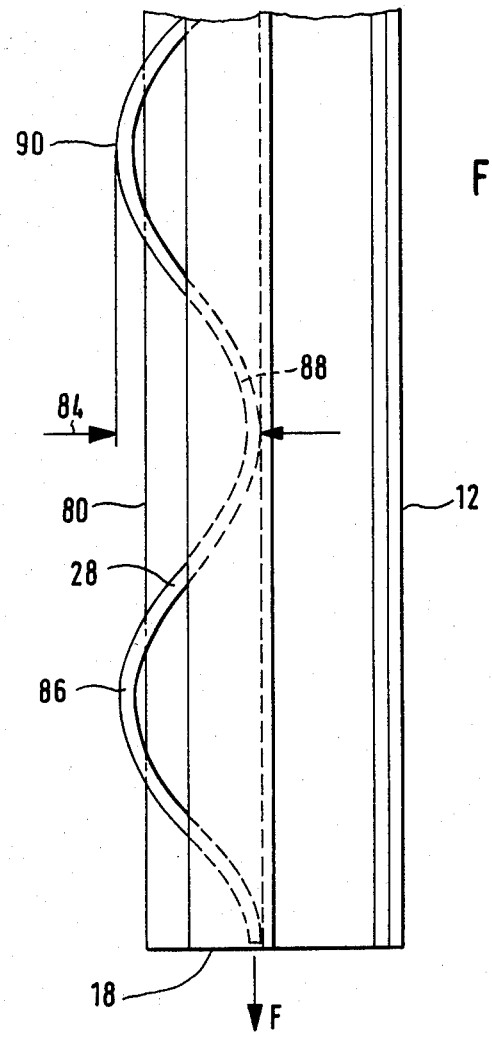
FIG. 4 is a plan view of an alternative embodiment, in which the connecting element is of wave shape design, that is, longitudinally sinusoidal.

FIG. 4 is again a plan view of the facing panel 12 with the connecting element 28 inserted, the latter having a somewhat wave shape in the direction of its longitudinal axis. The connecting element 28 is a blade made of spring-steel, for example, or of a deformable synthetic material which is similarly resilient, with an overall depth 84 between crest and bottom of successive arcs such as arcs 86, 88. One arc 86 projects beyond the outer edge 80 of the facing panel 12, while the other arc, or arcs 88, are located in the longitudinal second channel 18. If, during insertion into the profiled rail, not shown here, a longitudinal pull force F is applied to the connecting element 28, the depth 84 is reduced. The depth, resilient deformability, and the longitudinal pull force to be applied are related to each other in such a manner that, upon insertion, the crest 90 can slide without difficulty on the inner surface of the associated side flange, of the first channel 10, into which the groove 14 is undercut. In this embodiment, the spring force acting at right angles to inner surface 44 is predetermined, according to the invention, by having corrugations preliminarily formed in the connecting element 28 perpendicularly to the plane in which the arcs 86, 88 are located. The arc 86, at least, is provided with a rounded contour.

It is particularly pointed out here that, upon insertion, the longitudinal force F is produced automatically and without any additional measures. For instance, if the connecting element 28, inserted into the longitudinal channel 18, is pressed, together with the facing panel 12, into the profiled rail 2, a force acting substantially perpendicularly to the plane of the drawing is created which acts upon upwardly projecting arc 86. As a result of the construction of the connecting element, this also produces a component of force, so that the longitudinal force F, mentioned hereinbefore, comes into effect. If necessary, however, this longitudinal force F may also be applied additionally, or even partly from the outside.

Figure 5:
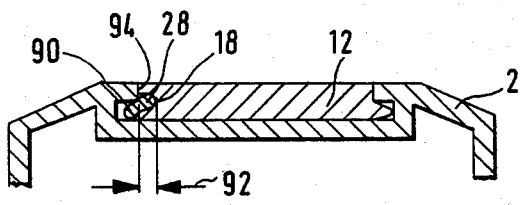
FIG. 5 is a cross-section, similar to that in FIG. 2, through another embodiment.

FIG. 5 illustrates another embodiment, in a cross-section similar to that in FIG. 2, but in this case the depth 92 of the longitudinal second channel 18 is comparatively narrow. The connecting element 28 is in the form of a "cord" made of rubber, a resilient synthetic material, or the like, running at right angles to the plane of the drawing in the direction of the longitudinal axis. In the direction of the longitudinal axis, therefore, the cross-section of the connecting element 28 is substantially constant, the said crosssection being approximately circular prior to insertion of the element 28 into profiled rail 2. Upon insertion into the profiled rail, the connecting element 28 is stretched in the direction of its longitudinal axis, the resulting reduction in cross-section making it possible for the outer edge 90, shown here in dotted lines, of the said connecting element 28 to slide upon the inner edge 94 of the relevant side flange of the channel 10. The longitudinal force is thereafter taken by the connecting element 28, making it possible for a cross-sectional expansion to take place in the manner shown. As may be seen, the outer edge 90 is also pressed, to some extent, out of the resilient connecting element 28, so that the originally completely circular cross-section no longer obtains. This is a particularly simple way of maintaining constant the mutual bracing between the facing panel 12 and the profiled rail 2. This is of critical importance in obtaining a connection free from play, with production tolerances being easily compensated for. According to the invention, inadvertent slipping or displacement of the facing panel 12 in the profiled rail 2 is thus avoided. Again, in this embodiment, a resilient area is provided which corresponds to the tongue 90 mentioned hereinbefore.

Figure 6:
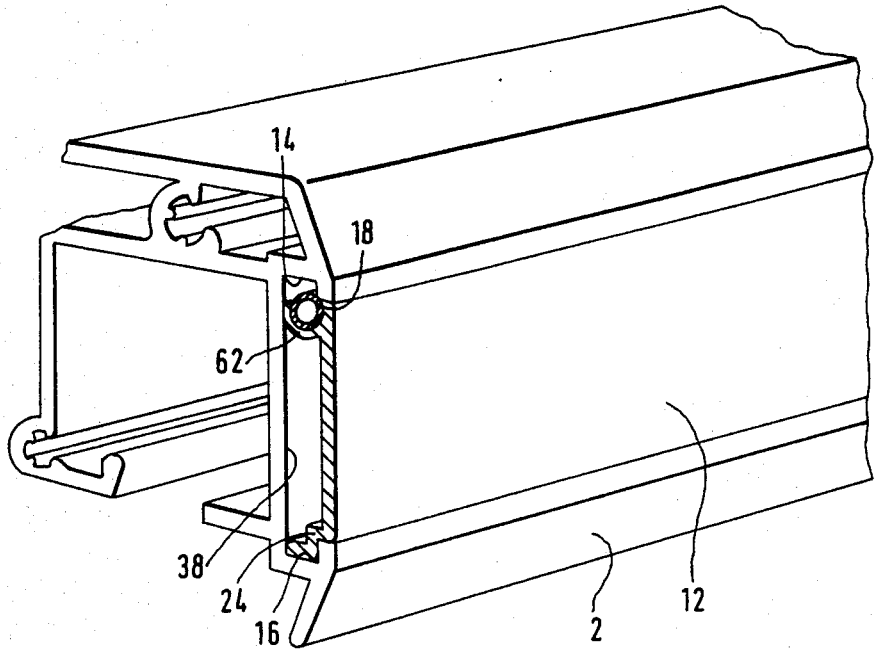
FIG. 6 is a perspective view of another embodiment, similar to that of FIG. 5.

FIG. 6 illustrates another embodiment wherein the web 62 is curved. This web rests upon the bottom surface 38 and defines the laterally open second channel 18. Arranged in the said channel is the resiliently flexible connecting element 28, the cross-section of which is annular. The said connecting element likewise bears upon the inner surface of the relevant side flange of the channel 10, a contact force being also produced by appropriate dimensioning. A force component directed towards the bottom surface 38 comes into effect. The facing panel 12 is thus reliably secured in the first channel 10 of the profiled rail 2 by the connecting element 28. The stepped leg 24 of the facing panel 12 enters into opposing groove 16. The shape of this leg is adapted to the contour of groove 16.

In the embodiment described above, one leg of facing panel 12 engages in the one groove 16, whereas the connecting element 28 enters into the opposing groove 14. Also within the scope of the invention, however, are embodiments in which the facing panel is secured in the opposing grooves by means of a connecting element in the manner described hereinbefore.

I claim:

1. A structural assembly, for a shower partition or the like, of the type comprising: a support member formed with an elongated first channel having a bottom surface and opposed longitudinal side flanges, one of said side flanges defining a groove opening over said bottom surface; an elongated facing panel fitting into said first channel and having opposed side edges disposed between said channel side flanges, and a connecting element interconnecting said support member and said facing panel, said connecting element engaging into said groove, the improvement wherein:

said facing panel is formed with means defining a second channel opening toward said groove, in interconnected condition of said support member and said facing panel;

said connecting element, when in said interconnected condition, is mounted partly in said second channel of said facing panel and partly in said groove of said one of said first channel side flanges;

said connecting element is made of resilient material, and the other of said first channel side flanges and the adjacent edge of said facing panel are formed with interlocking means whereby said panel member with said connecting element inserted in said second channel form a sub-assembly which may be mounted and removed from said support member by pivotal movement of said assembly about said interlocking means to allow resilient engagement and removal of said connecting elemeht in and out of said groove.

2. An assembly as claimed in claim 1, wherein said facing panel has an inner face looking toward said bottom surface of said first channel, said second channel-defining means projecting from said inner face, and wherein said connecting element is a generally flat member having at least one L-shaped slot formed therethrough to define a bendable lever on one edge of said member, said lever having a free end provided with a latch projecting from said one edge of said member and received in said groove, in said interconnected condition of said support member and said facing panel.

3. A structural assembly as claimed in claim 2, wherein said flat member is elongated and extends essentially the full length of said panel and is formed with a plurality of latch-provided bendable levers.

4. A structural assembly as claimed in claim 3, further including resilient presser elements on one face of said flat member to brace said flat member in a direction perpendicular to said bottom surface of said first channel to hold said facing panel against longitudinal displacement in said channel.

5. A structural assembly as claimed in claim 2, wherein said second channel-defining means comprises: a web projecting from said inner face and extending longitudinally along said facing panel and a straight leg projecting from the free end of said web in the direction of said groove and in parallel relation with said inner face, said straight leg resting upon said bottom surface of said longitudinal channel, in said interconnected position.

6. A structural assembly as claimed in claim 5, wherein said straight leg has a free edge standing short of said one of said flanges of said first channel having said groove, whereby to provide lateral holding support for said flat member.

7. Astructural assembly as claimed in claim 6, wherein said free edge of said straight leg extends about the middle of a longitudinal part of said L-shaped slot.

8. A structural assembly as claimed in claim 5, wherein said web extends approximately midway between said opposed side edges of said panel.

9. A structural assembly as claimed in claim 1, wherein said connecting element is a wave-like blade made of resilient material and defining successive arcs of equal depth rising from the bottom of said second channel, said depth exceeding the distance between the bottom of said second channel and one of said side edges of said facing panel adjacent said groove whereby, in said interconnected position, the crests of said arcs enter into said groove.

10. A structural assembly as claimed in claim 9, wherein said straight leg has a free edge standing short of said one of said flanges of said first channel having said groove, whereby to provide lateral holding support for said flat member.

11. A structural assembly as claimed in claim 10, wherein said free edge of said straight leg extends about the middle of a longitudinal part of said L-shaped slot.

12. A structural assembly as claimed in claim 1, wherein said second channel-defining means comprise: a longitudinal portion of said panel extending along said side edge of said panel adjacent said groove of said one of said channel side flanges, having a halfcylindrical shape in cross-sectional and acting as said second channel, said channel opening toward and bridging said one of said side flanges and the said groove; and wherein said connecting element is a cord of resilient material compressible so that, in said interconnected condition of said support member and said panel, said cord is firmly held partly in said second channel and partly in said groove.

13. A structural assembly as claimed in claim 12, wherein said cord is hollow, in cross-section.

14. A structural assembly as claimed in claim 12, wherein said cord is solid, in cross-section.

15. A structural assembly as claimed in claim 2, wherein said interlocking means comprises: a stepped leg along the other of said side edges of said facing panel and including a step portion; a further groove defined in the other of said flanges of said first channel, said step portion having a size to fit in said further groove when said facing panel and said support member are in said interconnected condition.

16. A structural assembly as claimed in claim 15, wherein said second channel-defining means comprises: a web projecting from said inner face and extending longitudinally along said facing panel and a straight leg projecting from the free end of said web in the direction of said groove and in parallel relation with said inner face, said straight leg resting upon said bottom surface of said longitudinal channel, in said interconnected position.

17. A structural assembly as claimed in claim 15, wherein said straight leg has a free edge standing short of said one of said flanges of said first channel having said groove, whereby to provide lateral holding support for said flat member.

18. A structural assembly as claimed in claim 15, wherein said second channel-defining means comprise: a longitudinal portion of said panel extending along said side edge of said panel adjacent said groove of said one of said channel side flanges, having a half-cylindrical shape in cross-sectional and acting as said second channel, said channel opening toward and bridging said one of said side flanges and the said groove; and wherein said connecting element is a cord of resilient material compressible so that, in said interconnected condition of said support member and said panel, said cord is firmly held partly in said second channel and partly in said groove.

* * * * *